United States Patent [19]

Rickard et al.

[11] 4,411,664

[45] Oct. 25, 1983

[54] WASHING MACHINE WITH OUT-OF-BALANCE DETECTION AND CORRECTION CAPABILITY

[75] Inventors: Jimmy R. Rickard; Robert K. Hollenbeck, both of Louisville, Ky.

[73] Assignee: General Electric Company, Louisville, Ky.

[21] Appl. No.: 373,591

[22] Filed: Apr. 30, 1982

[51] Int. Cl.[3] ..... D06F 23/04; D06F 33/02

[52] U.S. Cl. ..... 8/158; 8/159; 68/12 R; 68/23.3; 210/144

[58] Field of Search ..... 8/158, 159; 68/12 R, 68/23 R, 23.1, 23.3; 210/144

[56] References Cited

U.S. PATENT DOCUMENTS

| | | | |
|---|---|---|---|
| 2,917,175 | 12/1959 | Toma | 210/144 |
| 2,943,472 | 7/1960 | Painter | 68/12 R |
| 2,950,010 | 8/1960 | Bochan | 210/144 |
| 2,967,621 | 1/1961 | Metzger | 68/23.1 X |
| 2,986,913 | 6/1961 | Condit et al. | 68/12 R |
| 3,014,590 | 12/1961 | Metzger | 68/23.1 X |
| 3,209,561 | 10/1965 | Burdett | 68/23.1 |
| 3,268,791 | 8/1966 | Burns et al. | 68/23.1 X |
| 3,273,361 | 9/1966 | Smith | 68/12 R |
| 3,308,954 | 3/1967 | Powder | 210/144 X |
| 3,311,237 | 3/1967 | Bergeson et al. | 210/144 |
| 3,402,819 | 9/1968 | Mellinger | 210/144 |
| 3,447,686 | 6/1969 | Houser | 210/144 |
| 3,548,615 | 12/1970 | Ohnishi et al. | 68/23.1 |
| 3,583,182 | 6/1971 | Matsuura | 68/23.1 |
| 3,674,419 | 7/1972 | Tichy | 8/158 |
| 3,681,661 | 8/1972 | Koegel | 317/22 |
| 4,328,600 | 5/1982 | Bochan | 8/159 |

*Primary Examiner*—Philip R. Coe

*Attorney, Agent, or Firm*—Frederick P. Weidner; Radford M. Reams

[57] ABSTRACT

An automatic clothes washing appliance of the vertical axis type for a clothes washing operation having a plurality of cycles including wash and spin cycles incorporating a tub, a clothes receiving basket movably supported in the tub, means for distributing fill water to the articles received in the basket, and a drive motor which selectively drives the basket for a wash mode and a spin mode. The control system for the appliance includes an arrangement for detecting the existence of a basket out-of-balance condition in the spin mode and initiates a rebalance operation which includes means to measure the basket rotational speed during the spin mode and means responsive to detection of basket rotational speed being less than a predetermined normal balanced basket rotational speed at a predetermined time in the spin cycle to interrupt the spin cycle and to actuate a rebalance cycle and thereafter to resume the spin cycle.

13 Claims, 5 Drawing Figures

E
STOP SPIN CLOCK
TURN OFF MOTOR
SET C = C + 1
190
192
IS
C = 4
?
YES
TERMINATION
STEP
194
NO
WAIT
7 SECS.
195
SET T = 0
START TIMER T
TURN ON MOTOR FOR
REBALANCE CYCLE
196
198
IS
T = 30 SECS.
?
NO
YES
WAIT
7 SECS.
200
TURN ON MOTOR IN
SPIN MODE
202
D

WASHING MACHINE WITH OUT-OF-BALANCE DETECTION AND CORRECTION CAPABILITY

BACKGROUND OF THE INVENTION

The present invention relates to a washing machine of the vertical-axis type of the washing of fabric articles such as clothes, and more particularly to washing machines that have a system for detecting and correcting an out-of-balance condition during the spin cycle.

Automatic clothes washing machines customarily provide a sequence of operations in order to wash, rinse, and extract water from the clothes contained in a basket. A typical type clothes washing machine is shown and described in U.S. Pat. No. 3,570,274 assigned to the same assignee as the present invention. Such clothes washing machines have a non-rotating outer water containing tub and an inner perforated basket, the latter of which, during centrifugal liquid extraction operations, is spun at high speed so that liquid is forced from the clothes within the basket through the perforations in the basket and into the outer tub. From the outer tub the liquid is removed from the machine to a drain by an conventional pumping means. The sequence of operations ordinarily includes a washing operation which, in one typical of vertical axis machine, is provided by an agitator movably arranged to oscillate back and forth within the basket; a first centrifugal liquid extraction operation in which the wash water is removed from the clothes by spinning the basket; a rinsing operation in which the clothes in the basket are rinsed in clean water while the agitator is oscillated; and a final centrifugal liquid extraction operation in which the basket is spun to remove the rinse water from the clothes. Machines having this type of cycle, or a variation thereof, generally produce highly satisfactory results in that the clothes in the machine come out properly cleaned and with a substantial part of the liquid removed.

One disadvantage that can occur in such a clothes washing machine during the centrifugal liquid extraction operations or spin mode is that should the articles being washed bunch up or have unequal weight distribution about the axis of rotation the basket may become unbalanced. If the unbalance is sufficient during acceleration of the spinning basket, the basket may strike the outer tub which can result in injury to the machine and in some cases the striking may be so violent that the basket is prevented from reaching its intended rotational speed. The unbalance capacity of a given clothes washer machine is most noticeable when the clothes basket is being accelerated through its critical or resonance of vibration speed where it is likely to strike the tub due to an unbalance within the basket. It has been known that if the mass of the basket is increased such as for example by retaining a relatively high volume of water within the basket during its acceleration through the critical speed that the unbalance capacity will be improved. Accordingly unbalance problems most likely occur with small wash loads rather than large loads. For instance, such prior art disclosures are found in U.S. Pat. Nos. 3,306,082 and 2,976,998. The problem with these prior art clothes washing machines, however, is that while a greater volume of water may aid in improving the unbalance capacity of a machine, it detrimentally affects the power consumption necessary to accelerate the basket. In many cases the motor is insufficient to handle the load without increasing its size. In addition, the capability of extracting liquid from the clothes during the spinning is sacrificed.

The out-of-balance problem during the spin mode of a clothes washing operation is also present in orbital type washing machines such as, for example, the machine disclosed in U.S. patent application, Ser. No. 142,949, by John Bochan, filed Apr. 23, 1980. The orbital type washing machine is a vertical-axis type having a dynamic system which includes a single perforate wash basket arranged to be driven continuously such that its central axis moves in an orbital path about another axis. The basket is restrained from rotating about its central axis when it is moving about the other axis and each point of the basket moves in a circulate path having an effective diameter which is small in relation to the diameter of the basket and having substantially the same excursion as the orbital path of the central axis of the basket. Water and soil removing agents are introduced into the basket during orbital motion and that motion is effective to induce a continuous motion of the fabric article load for washing the load. Following washing preferably, the basket's central axis is positioned in substantial alignment with the axis about which it was orbiting and is rotated about this axis to centrifugally remove water from the fabric load. In order to achieve a satisfactory clothes washing operation and to avoid excessive loading of the motor, a means for automatically detecting and correcting any out-of-balance condition during the spin mode is desirable.

It is therefor an object of the present invention to provide a vertical-axis washing machine with means for detecting an out-of-balance condition during the spin mode early in the spin cycle and means for interrupting the spin mode upon detection of an out-of-balance condition and initiating a rebalance cycle and thereafter resume the spin mode.

SUMMARY OF THE INVENTION

In accordance with the present invention there is provided a clothes washing machine of the vertical-axis type for a clothes washing operation having a plurality of cycles including wash and spin cycles, which incorporates a substantially non-rotating or stationary tub and a clothes receiving basket movably supported in the tub. Means is provided for distributing fill water to the articles received in the basket. The means for distributing fill water is coupled to an external water supply by fill valve means to control delivery of fill water from the external supply. Motor means selectively operative in a wash mode and a spin mode to provide wash and spin operating cycles respectively and a means to limit torque to the basket to a known maximum value during spin acceleration are provided. Drain pump means removes water from the tub. Control means for controlling the actuation of the various machine components, including the motor, valves and drain pump, provides the desired cyclical operation of the appliance. The control means further includes detection means to detect the existence of an out-of-balance condition in the spin mode and initiating a rebalancing operation including means for measuring basket rotational speed during the spin mode early in the spin cycle and means responsive to detection of basket rotational speed being less than a predetermined normal balanced basket rotational sped at a predetermined time in the spin cycle to interrupt the spin cycle and to actuate a rebalance cycle and thereafter to resume the spin cycle.

DETAILED DESCRIPTION OF THE ILLUSTRATIVE EMBODIMENT

While this invention is applicable to both a vertical axis washing machine with an agitator movably arranged to oscillate back and forth within the basket in the wash mode and an orbital type vertical washing machine, the following detailed description of the illustrative embodiment will be for an orbital type washing machine.

Figure 1:
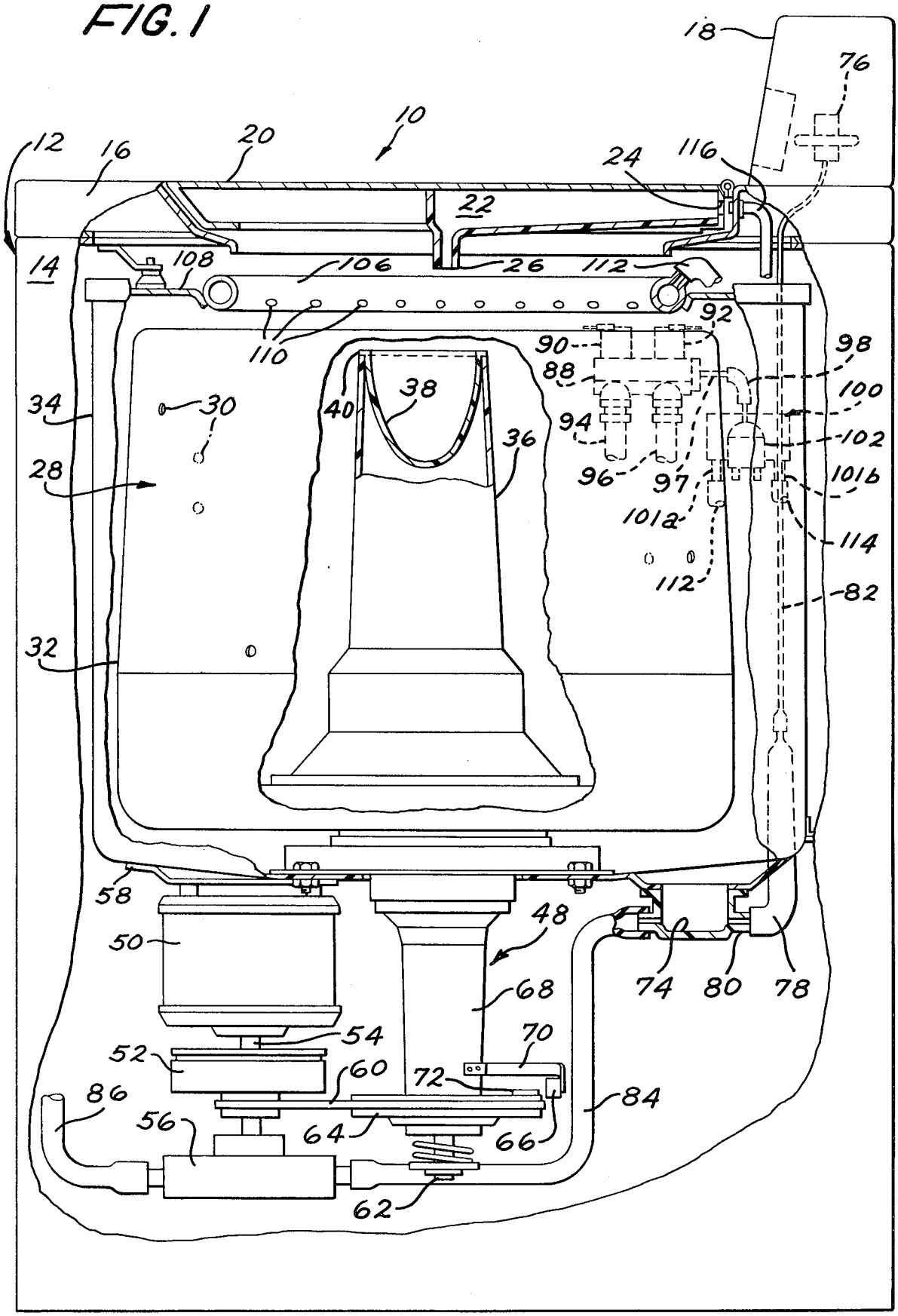
FIG. 1 is a side elevational view of a machine illustratively embodying one form of the present invention with portions removed to show various structural details thereof.

Referring now to FIG. 1, there is shown a washing machine 10 of the vertical axis type which includes a cabinet 12 having a base portion 14 and a top portion 16. Cabinet top 16 includes a control panel 18 normally provided with a plurality of switches and controls for user control of the operation of the machine. Cabinet top 16 is also provided with an access lid 20 hinged for movement between a closed position as shown and an open position permitting access to the interior of the washing machine. Lid 20 is provided with a water receiving trough or compartment 22 having a fluid inlet aperture 24 and a discharge spout 26.

A single clothes receiving wash basket 28 having perforations 30 formed in its side wall 32 is disposed within an outer imperforate tub or casing 34. The basket 28 receives items such as fabric articles to be washed as well as the washing medium, usually water. Basket 28 includes a center post 36 with a cup-shaped receptacle 38 attached thereto, the annular rim 40 of the receptacle 38 engaging the upwardly extending cylindrical wall of post 36. Receptacle 38 is adapted to receive and dispense detergent and/or other wash additives.

Basket 28 is driven by a transmission arrangement designated generally 48 and operated in response to operation of a reversible motor 50 through a system including a suitable load-limiting clutch 52 mounted on motor shaft 54. Shaft 54 also supports and drives a drain out pump 56 as is customary in the art. Motor 50 and the structure supported thereby are suitably mounted to tub 34 by mounting member 58. A suitable rotary drive belt 60 transmits power from clutch 52 to the input shaft 62 of transmission 48 through pulley 64. Depending upon the direction of motor rotation, pulley 64 and therefore input shaft 62 of transmission 48 is driven in opposite directions. When motor 50 is operated in its wash mode, it rotates shaft 62 in one direction offsetting the central basket axis laterally relative the axis of input shaft 62 and causing the central axis of basket 28 to orbit about the axis of input shaft 62 in a substantially horizontal plane. This orbital movement of basket 28 imparts a washing action to the clothing articles received within the basket. When motor 50 is operated in its spin mode, shaft 62 is rotated in the opposite direction. Transmission 48 aligns the axis of basket 28 with the axis of input shaft 62 and rotates the basket at a high speed substantially about its own axis for the centrifugal extraction of liquid from the clothing and from the basket.

Means for sensing the rate of rotation of transmission shaft 62 is provided in the form of a magnetically actuated reed switch 66 disposed adjacent pulley 64 and secured to transmission housing 68 by a mounting bracket 70. Magnet means in the form of a rectangular segment of magnetic material 72 is secured to pulley 64 for rotation therewith. Reed switch 66 is a normally open switch which is momentarily actuated or closed by magnet 72 upon each pass of magnet 72 past switch 66.

A sump 74 is secured in an opening of the bottom of tub 34 to receive washing liquid flowing from basket 28. Pump out pump 56 is connected to sump 74 by a hose 84 for withdrawing water from tub 34. Pump 56 is formed so that in either direction of motor rotation, pump 56 will draw liquid from sump 74 through hose 84 and discharge it through hose 86 to a suitable drain (not shown). The particular form of pump 56 is not significant so long as the pump withdraws liquid from the tub in response to motor rotation in either direction.

A water level switch 76, which may be of a type well known in the art, is mounted in control panel 18. An air chamber 78 is connected to nipple 80 of sump 74 and a hose 82 connects air chamber 78 to switch 76. As water accumulates in sump 74, the air in chamber 78 is compressed and switch 76 is closed. Closure of pressure switch 76 by water accumulating in sump 74 causes, among other actions to be discussed in more detail hereinafter, motor 50 to be energized thereby causing pump 56 to withdraw liquid from the sump when the amount of liquid received therein exceeds a predetermined amount.

Washing machine 10 is a fresh water flow through machine. The machine includes water supply means in the form of a solenoid operated mixer valve 88 (shown in phantom) having solenoids 90 and 92 coupled to sources of hot and cold water, respectively, such as household faucets by hoses 94 and 96, respectively. By selective energization of solenoids 90 and 92, hot, cold or warm water will be provided at the output pipe 97 of valve 88. The water from mixer valve 88 is fed through a conduit 98 to a solenoid diverter valve assembly 100 having a solenoid operated control valve 102 for controlling distribution of the water to basket 28 in a manner to be described hereinafter.

Means for distributing fill water to the articles received in the basket 28 are provided. In the washing machine 10 shown there is spray means for distributing fill water substantially over the topmost layer of clothing articles received in basket 28 including a fill ring 106 which is secured to an annular mounting frame 108 which in turn is suitably secured to the upper extremity of tub 34. Fill ring 106 is a continuous hollow annular tube having a plurality of apertures 110 formed therein so that water will spray downwardly therefrom all around the inside of basket 28. Fill ring 106 is coupled to outlet ports 101*a* of diverter valve assembly 100 by hose 112. When diverter valve 102 is de-energized or closed, all of the water entering assembly 100 is fed through hose 112. Water may also be delivered to basket 28 through trough 22 and spout 26 formed in lid 20. Hose 114 connects outlet port 101*b* of assembly 100 to a fluid nozzle 116 which is secured in an aperture formed in cabinet top 16. Nozzle 116 is in juxtaposition to inlet aperture 24 formed in lid 20 to supply water to trough 22. Output from trough 22 is discharged from spout 26 into the dispensing receptacle 38 for mixing with the detergent, liquid or granules, which have been placed therein. When valve 102 is energized or open, flow from diverter valve assembly 100 is divided between hoses 112 and 114 in a predetermined ratio such as, for example, 4 to 1.

The structural details of the basket, transmission and suspension system for machine 10 are disclosed in greater detail in commonly-assigned, copending U.S. patent applications, Ser. No. 142,949, filed Apr. 23, 1980, on behalf of John Bochan; and Ser. No. 203,208, filed Nov. 3, 1980, by Gerald L. Roberts, the disclosures of which are hereby incorporated by reference.

A typical clothes washing operation for the above-described washing machine proceeds as follows: The clothes to be washed are placed within the basket 28 and a desired amount of detergent is placed in receptacle 38. The user then chooses the appropriate cycle times and water temperatures for wash and rinse and turns on machine 10 by actuating the start switch. First, there is an initial wet down or soaking of the fabric articles in basket 28 by the flow of water from fill ring 106 without any flow of water from trough 22. This action thoroughly wets the clothes and prepares them for washing without using any detergent. When the clothes are thoroughly soaked, water will drain through perforations 30 to the bottom of tub 34 and into sump 74. When sufficient water collects in sump 74 pressure switch 76 is actuated causing motor 50 to be energized which in turn causes transmission 48 to move basket 28 in its orbital or washing mode. Closing of switch 76 also results in the energization of diverter valve 102 so that the flow of water is divided between ring 106 and trough 22. The water directed to the trough 22 flows from spout 26 into detergent receptacle 38 where it mixes with the detergent in receptacle 38. Due to the orbital motion of the basket, this relatively concentrated solution of water and detergent is ejected from receptacle 38 and mixes with the clothing.

At the conclusion of the wash cycle, there is a spin cycle in which there is a centrifugal extraction of wash water from the clothing in the basket. To accomplish this, the direction of rotation of motor 50 is reversed. This causes transmission 48 to align the axis of basket 28 with the main drive axis of input shaft 62 and to rotate basket 28 about this axis. Conventionally, perforations 30 are provided in the cylindrical side wall of the basket 28 which perforations usually have a pattern of multiple circular rows which extend from near the top of the basket to near the bottom of the basket. The purpose of these holes or perforations and their pattern arrangement is to provide passageways through the basket 28 so that water being extracted centrifugally from the clothes may very readily pass into the tub whereupon it is removed by the pump mechanism. The pump 56 removes the centrifugal water from the machine.

The rinse process following the centrifugal extraction of the wash water is very similar to the wash process with orbital movement of the basket, but often with a change in the water temperature selection. In rinse, the flow normally will be through the fill ring 106 only, either in a continual or pulsed fashion continuing throughout the rinse process. Upon conclusion of the rinse portion of the cycle, the water flow is terminated and the machine enters another centrifugal water extraction or basket spin mode of operation such as described above.

The spin mode is provided at a relatively high speed of terminal rotation of the basket that may, for instance, be on the order of 600 revolutions per minute, which is the case in the preferred embodiment, so as to extract a very substantial part of the liquid from the clothes. Just prior to when the spin mode is started the basket including the clothes and any water contained therein are static. When the spin operation is initiated there is considerable torque required on behalf of the motor and the connecting mechanisms between the motor and the basket to spin the combined mass of basket, clothes and water. The rotational speed of the basket 28 will be accelerated gradually and will reach its critical rotational speed which in the machine described in the preferred embodiment is approximately 120 revolutions per minute. Critical speed is that speed whereupon the natural frequency or resonance of vibration of the system occurs. Once the basket and its contents reach post critical speed, that is above 120 revolutions per minute, any existing unbalance condition is relatively small enough not to affect the acceleration of the basket up to its maximum rotational speed which as indicated previously may be approximately 600 revolutions per minute. When the basket 28 and its contents are being accelerated through the critical rotational speed it is highly desirable to prevent any unbalance condition from causing the basket 28 to strike the tub 34. To detect an out-of-balance condition there is a maximum torque value available to the basket in the spin mode for any given washing appliance. In the machine shown and described the clutch 52 functions to limit such maximum torque value.

Figure 2:
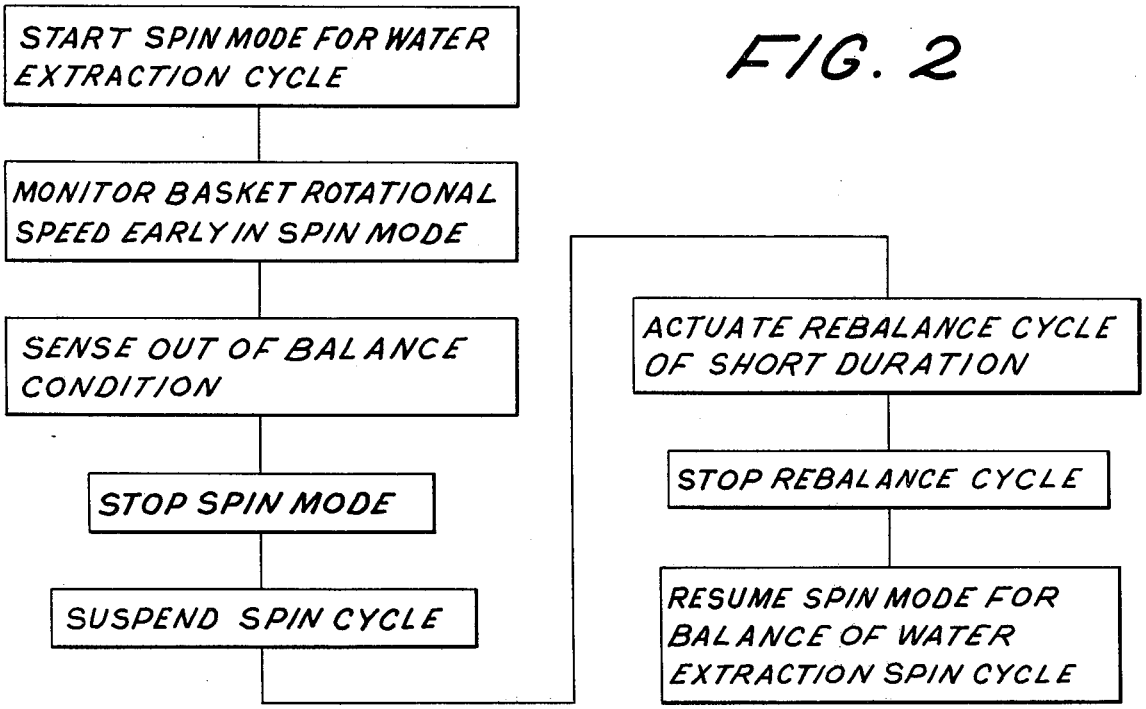
FIG. 2 is a block diagram illustrating the steps implemented by the control system of the washing machine of FIG. 1 to carry out a method in accordance with the present invention.

The steps comprising a method in accordance with one aspect of the invention for detecting and correcting an out-of-balance condition in the spin mode are illustrated in FIG. 2. A motor condition such as speed or power factor is monitored for changes in the monitored parameter indicative of an out-of-balance condition after the spin mode has started. Upon sensing such a change, corrective action is initiated comprising the steps of stopping the spin mode, suspending the spin cycle and actuating a rebalance cycle, which in the case of the illustrative embodiment, is the same as the wash mode but of short duration and without the addition of water and then resuming the spin mode for the balance of the interrupted or suspended spin cycle. In the case of a vertical axis washing machine with an agitator movably arranged to oscillate back and forth within the basket in the wash mode it may be advantageous to add a small amount of water during the rebalance cycle to help redistribute the clothes load in the basket.

There is a possibility that the rebalance cycle will not redistribute the clothes load sufficiently to cure the out-of-balance condition. In the preferred embodiment of the invention, control means are provided to repeat the detecting and correcting steps discussed above each time there is a resumption of the spin mode for the balance of the water extraction spin cycle. Preferably the steps of detecting and correcting an out-of-balance condition in the spin mode are repeated three times and if the out-of-balance condition persists, the control means terminates the entire washing operation and, if desired, a signal to that effect is initiated.

In the form of the invention embodied in machine 10, the particular motor condition monitored is motor speed. The gear reduction effects of the drive belt arrangement, drivingly linking motor 50 with transmission shaft 62, provides essentially a 3:1 ratio of motor speed to transmission shaft speed. Thus, in the illustrative embodiment motor speed is sensed by sensing the rate of rotation or speed of the transmission shaft. Under normal operating conditions, motor 50 rotates at a nominal rate of 1800 rpm, driving transmission shaft 62 at a nominal rate of 600 rpm.

Figure 3:
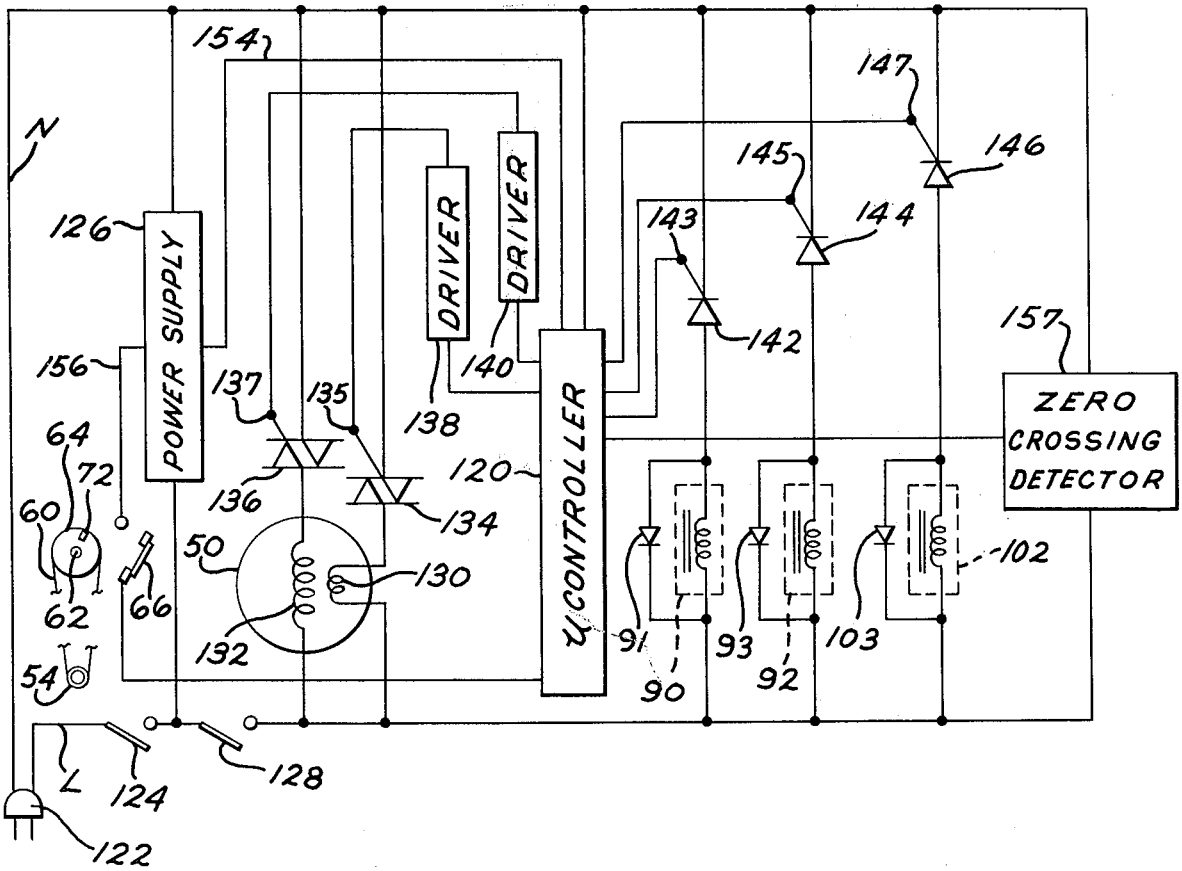
FIG. 3 is a simplified schematic circuit diagram of the control system of the washing machine of FIG. 1.

Referring now to FIG. 3, a washing machine control system for implementing the foregoing method of detecting and correcting an out-of-balance condition in the spin mode is shown in which a preprogrammed electronic controller 120 is employed to direct the functional operation of the various mechanical and electromechanical and electronic elements of washer 10. These various elements of washer 10 include output devices such as solenoids and solid state switching elements actuated by controller 120 and controller input devices in the form of mechanical switches. Additional input and output devices such as a keyboard input means and output display means have been deleted from the diagram for purposes of simplicity and clarity.

Electronic controller 120 is preferably a self-contained integrated circuit including an arithmatic logic unit, appropriate memory registers, and input and output circuits, as is well known in the art. In the illustrative embodiment, controller 120 is a readily commercially available single chip MOS microcontroller designated COP420L manufactured by National Semiconductor Corporation. This device is described in detail in National Semiconductor Publication entitled COP420L/421L and COP320L/COP321L Single Chip MOS Microcontrollers, copyright April 1980, which is hereby incorporated by reference.

In FIG. 3, power is provided through power plug 122 adapted to connect conductors L and N to a standard household electrical receptacle. Power is supplied to the appliance through user actuated ON/OFF switch 124 serially connected in conductor L. A conventional low voltage DC power supply 126 is connected across conductors L and N, to provide low voltage DC for the electronic controller 120. Lid-actuated switch 128 is connected serially in line L to prevent energization of various operating components in the circuit when the lid of the machine is opened.

Electric motor 50 is a single phase synchronous induction motor of the conventional type including a start winding 130 and a run winding 132. Start winding 130 is connected in series with triac 134 across conductors L and N. Similarly, run winding 132 is serially connected with triac 136 across conductors L and N. Triacs 134 and 136 are conventional thyristors capable of conducting current in either direction irrespective of the voltage polarity across their main terminals when triggered by gate signals of positive or negative polarity applied to the gate terminals 135 and 137, respectively. Energization of motor 50 and its directin of rotation are controlled by controller 120 which provides gating signals to triacs 134 and 136 through conventional amplifying driver circuits 138 and 140, respectively.

As previously described, motor 50 is a reversible motor arranged to rotate in one direction for wash and the opposite direction for spin. Motor direction may be determined by the timing of the gate signals to the start and run triacs. This manner of controlling motor operation is described in detail in copending, commonly-assigned patent application, Ser. No. 318,717, filed Nov. 6, 1981, by Hollenbeck et al, the disclosure of which is hereby incorporated by reference.

Each of valve control solenoids 90, 92 and 102 are serially connected across conductor L and N through silicon controlled rectifiers (SCR) 142, 144 and 146, respectively. Diodes 91, 93 and 103 are connected in electrical parallel with solenoids 90, 92 and 102, respectively, to act as transient suppressors. Trigger or gate signals are applied to gate terminals 143, 145 and 147, of SCR's 142, 144 and 146, respectively, by controller 120 to actuate valves 90, 92 and 102, respectively.

DC power supply 126 provides a low DC voltage for operation of microcontroller 120 through conductor 154. A pulsating DC voltage signal having a pulse repetition rate proportional to motor speed is provided to microprocessor 120 through magnetic reed switch 66 via conductor 156. As is represented schematically in FIG. 3, reed switch 66 responds to passage of magnet 72 carried by pulley 64 such that a pulse train is provided to microcontroller 120 on conductor 156 having a pulse repetition rate proportional to the rate of rotation of transmission shaft 62.

A conventional zero crossing detector circuit 157 connected across conductors L and N provides the microcontroller with a synchronizing signal upon the occurrence of each zero crossing of the line voltage signal to enable controller 120 to synchronize operation with zero crossings of the power signal.

In accordance with one aspect of the invention, the detection means for detecting an out-of-balance condition in the spin mode comprises means for sensing the rate of rotation of the transmission shaft 62 in the form of magnet 72 secured to pulley 64 for rotation therewith and magnetic reed switch 66 disposed adjacent pulley 64 for momentary actuation by magnet 72 upon each pass of magnet 72 such that the frequency of actuation is representative of the speed of motor 50. As shown schematically in FIG. 3, one side of switch 66 is connected to the power supply 126 and the other is connected to an input port of microcontroller 120. A pulsating measurement signal or pulse train is thus provided to microcontroller 120 having a pulse repetition rate or frequency proportional to the speed of motor 50.

The control means comprises electronic controller means responsive to the measurement signal including an appropriate programmed segment of microcontroller 120 operative to detect changes in the repetition rate and upon detection of a change in repetition rate of a predetermined magnitude indicative of an out-of-balance condition in the spin mode to deenergize motor 50, thereby interrupting the normal spin cycle and to actuate for a first predetermined short wash mode period causing the basket to orbit as previously discussed to thereby move the clothes within the basket and redistribute them and thereafter to resume the normal spin cycle from the point of interruption.

In order to detect changes in rotation rate represented by changes in pulse repetition rate, an appropriately programmed segment of microcontroller 120 defines a recurring measurement interval of predetermined duration and increments an internal counter upon receipt of each pulse from switch 66 during the measurement interval. This counter is reset at the beginning of each interval; hence, the count at the end of the interval represents the rate of rotation of shaft 62 which is proportional to the speed of motor 50.

Shaft speed is monitored at a specific delay time after initiation of the spin cycle which is indicative of an out-of-balance condition for the maximum torque value available to the basket set by the machine design during the spin mode by comparing speed measurement to a reference count. If the reference count exceeds the present count an out-of-balance condition is identified.

In the illustrative embodiment a duration of 7.5 seconds is selected for the measurement interval to provide the satisfactory measurement accuracy. The tolerance in the number of counts is +1 count. Each count corresponds roughly to 8 rpms. Thus, for the 7.5 second interval a shaft speed of 120 rpms corresponding to a motor speed of 360 rpms would result in a count of 15. Thus, shaft speed can be measured with a tolerance of ±4 rpms.

Figure 4:
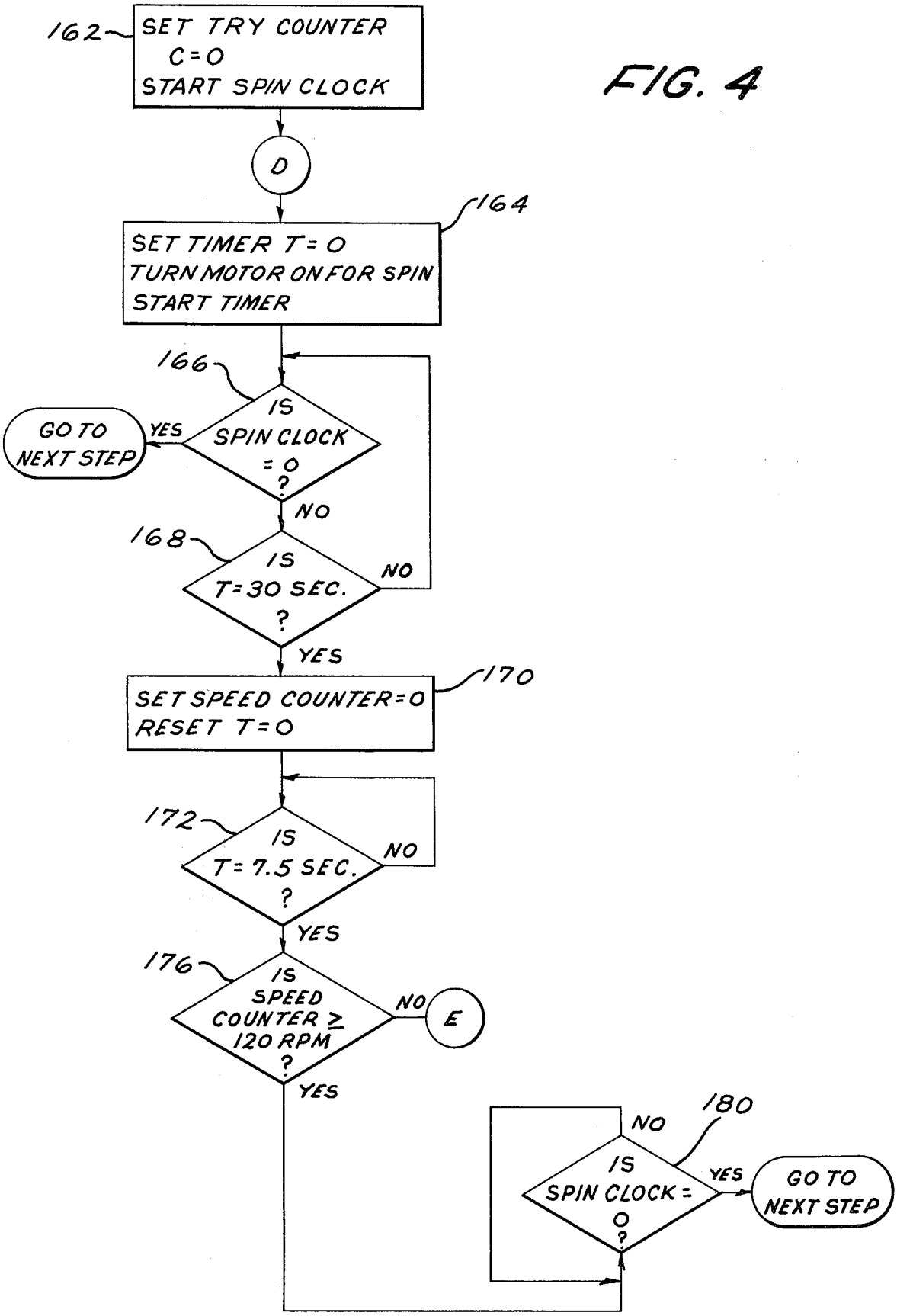
FIGS. 4 and 5 are program flow diagrams showing the manner in which the microcontroller of the control system of FIG. 3 can be programmed in accordance with the present invention.
Figure 5:
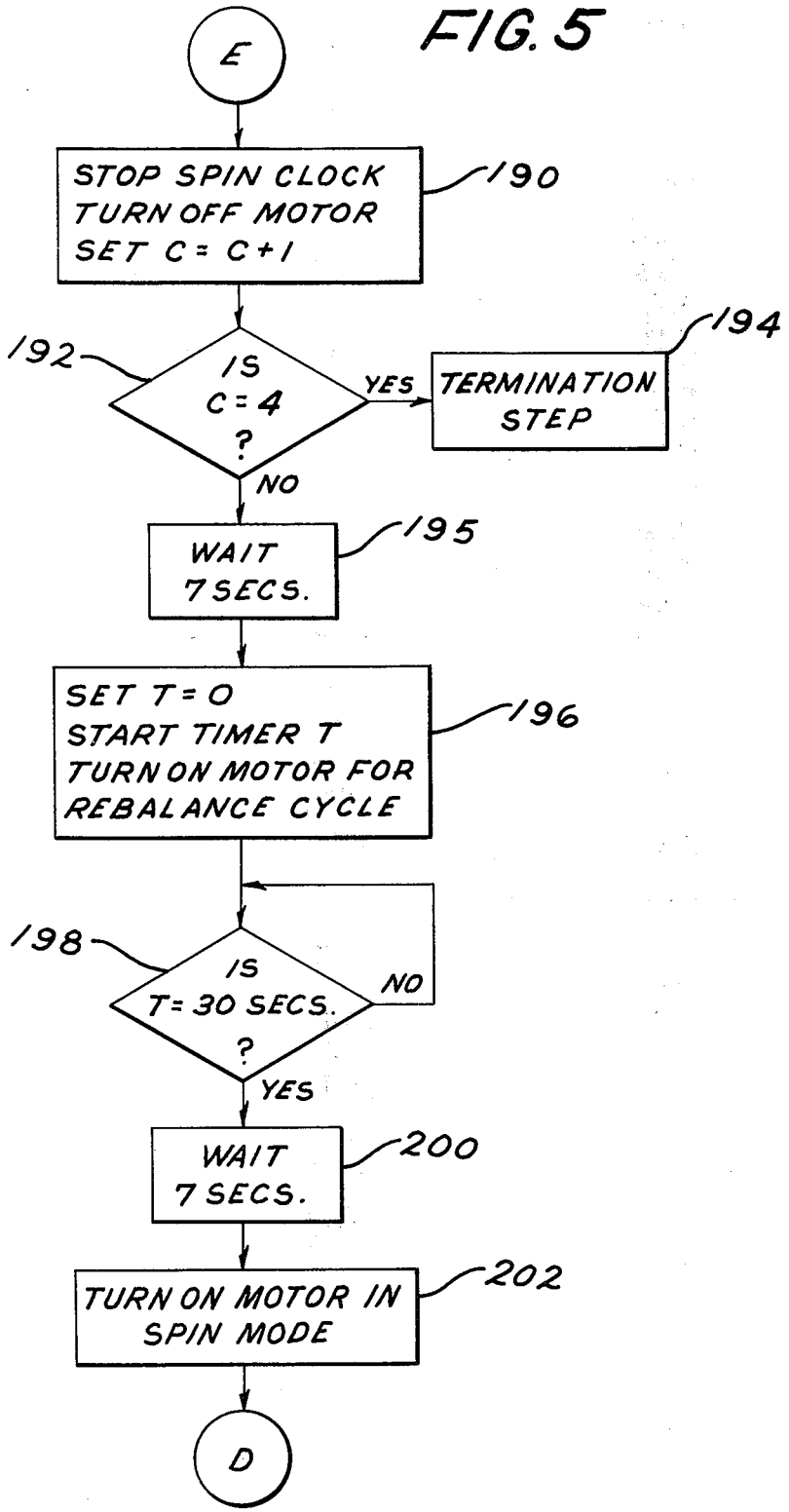

The Read Only Memory of microcontroller 120 is permanently configured to control operation of washing machine 10 in accordance with a predetermined set of instructions. In accordance with the present invention, the instruction set includes instructions for the detection of an out-of-balance condition during the spin cycle and the implementation of corrective action described hereinbefore with reference to FIG. 2. FIGS. 4 and 5 are flow diagrams which illustrate that portion of the control routine implemented in microprocessor 120 which enables it to perform the detection and correction functions. From these diagrams, one of ordinary skill in the programming art can prepare a set of instructions for permanent storage in the Read Only Memory of microprocessor 120. It will be appreciated that the illustrated flow charts may represent only a portion of a complete program for microcontroller 120 by which other functions of the washing machine 10 are also controlled.

The out-of-balance detection and correction instructions are represented for purpose of illustration as a detection subroutine depicted in the flow diagram of FIG. 4 and a correction subroutine depicted in the flow diagram of FIG. 5. It is to be understood that these instructions could be implemented as a self-contained subroutine or interleaved with instructions relating to other machine functions. In operation, the detection instructions direct microcontroller 120 to periodically determine present motor speed, compare the present speed to a stored reference value; and branch to the correction instructions if the present speed is less than the reference speed 30 seconds after the start of the spin cycle.

Microcontroller 120 is programmed to provide various counters and registers used in executing the instructions represented in the flow diagrams of FIGS. 4 and 5, including a "TRY" counter, a Spin Clock, a timer T, and a Speed Counter. The TRY counter is employed to limit the number of times the out-of-balance corrective cycle is implemented during any one spin cycle. The Spin Clock is an internal clock which is initially set to the desired time duration for the spin mode of operation, i.e. the spin cycle. The duration for a particular cycle is determined by user cycle selection according to such factors as load size and type of fabrics in the load. As the spin cycle progresses, the Spin Clock is decremented in real time. When the Spin Clock is decremented to zero, spin cycle ends and the controller proceeds to the next cycle, if any, or terminates the clothes washing operation. The timer designated simply T is a real time timer employed to control the duration of various time periods during the spin cycle. The Speed Counter counts pulses from reed switch 66.

Referring now to FIG. 4, at the beginning of the spin cycle the TRY counter is set to zero and the Spin Clock is started (Block 162). Then timer T is set to zero, timer T is started and motor 50 is energized for operation in the spin mode by application of appropriate trigger signals to triacs 134 and 136 (Block 164).

Inquiry 166 terminates the spin cycle when the Spin Clock times out. Inquiry 168 provides a 30 second delay before initiating a speed measurement. After 30 seconds, the speed counter is set to zero and timer T is reset to zero (Block 170). Inquiry 172 provides a 7.5 second delay which defines the speed measurement interval. During this interval, the speed counter is incremented upon receipt of each pulse from reed switch 66. At the conclusion of the speed measurement interval, the count of speed counter representing the number of rotations of transmission shaft 62 during the interval which is proportional to basket speed to be compared with a stored value representing the critical speed (120 rpm). If the basket speed at this time is less than or equal to 120 rpm, the program flow proceeds to step 190 (FIG. 5). If the basket speed is greater than the critical speed (120 rpm) at this time the program flow proceeds to step 180 for the duration of spin cycle then proceeds to the next step.

When an out-of-balance condition is detected the program branches to the out-of-balance correction instructions (FIG. 5). The correction instructions implement the following steps: stops the spin mode by turning off the motor 50 and suspends the spin cycle (Block 190). Inquiry 192 limits the number of correction attempts per washing operation by causing the program to branch to the termination step (Block 194) upon the fourth detection of an out-of-balance condition during the spin mode. Otherwise there is a short period of delay to stabilize the system, say 7 seconds (Block 195), then timer T is set to zero and started and the motor 50 to initiate the wash mode without the addition of water or rebalance cycle is turned on (Block 196). Inquiry 198 provides a 30 second rebalance cycle and when T equals 30 seconds the motor is turned off to terminate the rebalance cycle and there is a short period of delay, 7 seconds, to again stabilize the system (Block 200). After the delay, motor 50 is energized for the spin mode by appropriately triggering triacs 134 and 136 and T is reset to zero (Block 202). The program then returns to point D of FIG. 4 at which point the spin clock is restarted and the spin cycle resumes as before with continuing speed measurements until terminated by timing out of the spin clock or until an out-of-balance condition is again detected, in which case another branch to the correction instructions occurs.

It will be appreciated that there has been described herein an orbital type washing machine including a simple and effective out-of-balance in the spin cycle detection and correction system. It should be understood, however, that while particularly advantageous in machines of the orbital type, this out-of-balance detection and control arrangement may also be applicable to the more conventional agitator-type washing machines. As mentioned previously, in a conventional agitator-type washing machine the rebalance cycle, which may be the wash mode where the agitator oscillates back and forth, could include the addition of a small amount of water by actuating the fill valve to partially refloat the clothes and help move the clothes being washed in the basket around and be more evenly distributed thus correcting the out-of-balance load. It is realized that numerous other modifications and changes will occur to those skilled in the art. It is therefore to be understood that the appended claims are intended to cover all such modifications as fall within the true spirit and scope of the invention.

We claim:

1. A clothes washing appliance of the vertical axis type for a clothes washing operation having a plurality of cycles including wash and spin cycles, said appliance comprising:

a substantially stationary tub;

a clothes receiving basket movably supported in said tub;

means for distributing fill water to the articles received in said basket;

fill valve means for controlling the delivery of fill water from an external supply to said distributing means;

motor means selectively operative in a wash mode and a spin mode to provide wash and spin operating cycles, respectively;

pump means for removing water from said tub;

clutch means to limit the maximum torque value available to the basket in the spin mode; and control means for detecting an out of balance condition in the spin mode and initiating a rebalancing operation including means for measuring basket rotational speed during the spin mode and means responsive to detection of basket rotational speed being less than a predetermined normal balanced basket rotational speed at a predetermined time in the spin cycle to interrupt the spin cycle and to actuate a rebalance cycle and thereafter to resume the spin cycle.

2. The clothes washing appliance of claim 1 wherein the control means will initiate a limited number of sequential rebalancing operations and terminate the clothes washing operation in the event the out of balance condition is not corrected.

3. The clothes washing appliance of claim 1 wherein the rebalance cycle is an additional wash cycle of short duration.

4. The clothes washing appliance of claim 3 wherein the additional wash cycle of short duration is without the addition of fill water.

5. The clothes washing appliance of claim 1 wherein the predetermined length of time of the spin cycle is suspended during the rebalancing cycle.

6. The clothes washing appliance of claim 1 wherein the means for measuring basket rotational speed during the spin cycle is pulsed.

7. A method for detecting and correcting an out of balance condition in an automatic washing appliance of the vertical axis type having a plurality of cycles including wash and spin cycles and having a substantially stationary tub and a clothes receiving basket movably supported in the tub including means for distributing fill water to the articles received in the basket and fill means for controlling the delivery of fill water from an external source to the distributing means, and having a motor means selectively operative in a wash mode and a spin mode to provide wash and spin operating cycles of predetermined lengths of time and including pump means for removing water from the tub and means to limit the maximum torque available to the basket in the spin mode, the method comprising the steps of;

measuring the basket rotational speed during the spin cycle;

detecting the basket rotational speed being less than a predetermined normal balanced basket rotational speed at a predetermined time in the spin cycle;

interrupting the spin cycle;

actuating a rebalance cycle, and resuming the spin cycle after completion of the rebalance cycle.

8. The method of claim 7 wherein a limited number of sequential rebalancing operations are performed and in the event rebalance is ineffective and the out of balance condition is not corrected terminating the clothes washing operation.

9. The method of claim 7 wherein the predetermined length of time of the spin cycle is suspended during the rebalancing cycle.

10. The method of claim 7 wherein measuring the basket rotational speed during the spin cycle is by pulsating a measurement signal.

11. The method of claim 7 wherein the step of detecting the basket rotational speed being less than a predetermined normal balanced basket rotational speed is accomplished at about 30 seconds after start of the spin cycle.

12. The method of claim 7 wherein the step of rebalancing is an additional wash cycle of short duration.

13. The method of claim 12 wherein rebalancing with an additional wash cycle of short duration is without the addition of fill water.

* * * * *